United States Patent [19]

Wilmeth

[11] 4,200,011

[45] Apr. 29, 1980

[54] HIGH POWER WRENCHING TOOL

[75] Inventor: Claude H. Wilmeth, Montgomery, Tex.

[73] Assignee: N-S-W Corporation, Austin, Tex.

[21] Appl. No.: 958,757

[22] Filed: Nov. 8, 1978

[51] Int. Cl.[2] ..... B25B 13/46

[52] U.S. Cl. ..... 81/57.39

[58] Field of Search ..... 81/57.39

[56] References Cited

U.S. PATENT DOCUMENTS

| | | | |
|---|---|---|---|
| 3,706,244 | 12/1972 | Wilmeth | 81/57.39 |
| 3,930,776 | 1/1976 | Keller | 81/57.39 |
| 4,027,561 | 6/1977 | Junkers | 81/57.39 |
| 4,091,890 | 5/1978 | Wilmeth et al. | 81/57.39 |

*Primary Examiner*—James L. Jones, Jr.
*Attorney, Agent, or Firm*—Michael P. Breston

[57] ABSTRACT

The high power wrenching tool includes a high-torque ratchet wrench, a reaction frame which supports the ratchet wrench, and a fluid actuator on the frame for actuating the wrench. The wrench comprises two parallel side plates. Each plate has at one end thereof a bore. A ratchet wheel and a cooperating pawl are operatively disposed between the plates. The ratchet wheel has a center slot and carries a plurality of angularly-spaced teeth. The frame has at one end a pair of transversely-spaced outer rings positioned adjacent to the ratchet wheel. A pair of hubs are removably securable to the opposite sides of the wheel and are rotatably mounted in the frame's outer rings. Each hub has a slot identical to the slot of the wheel and in register therewith. The reciprocating actuator is detachably coupled between the pawl arm and the other end of the frame.

7 Claims, 12 Drawing Figures

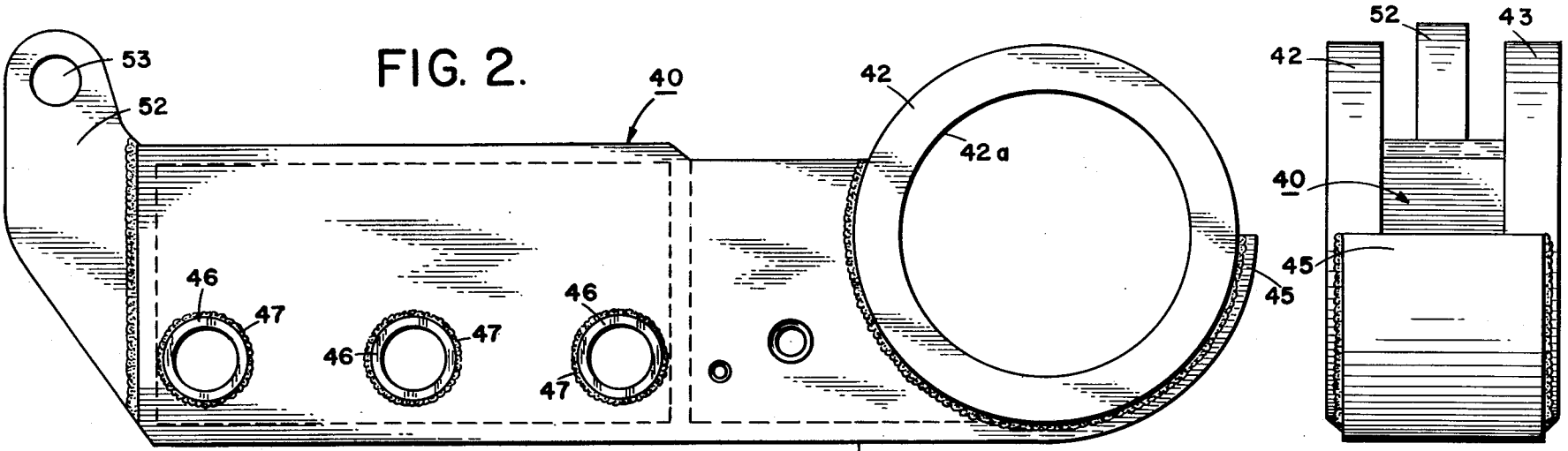
FIG. 2.
FIG. 3.
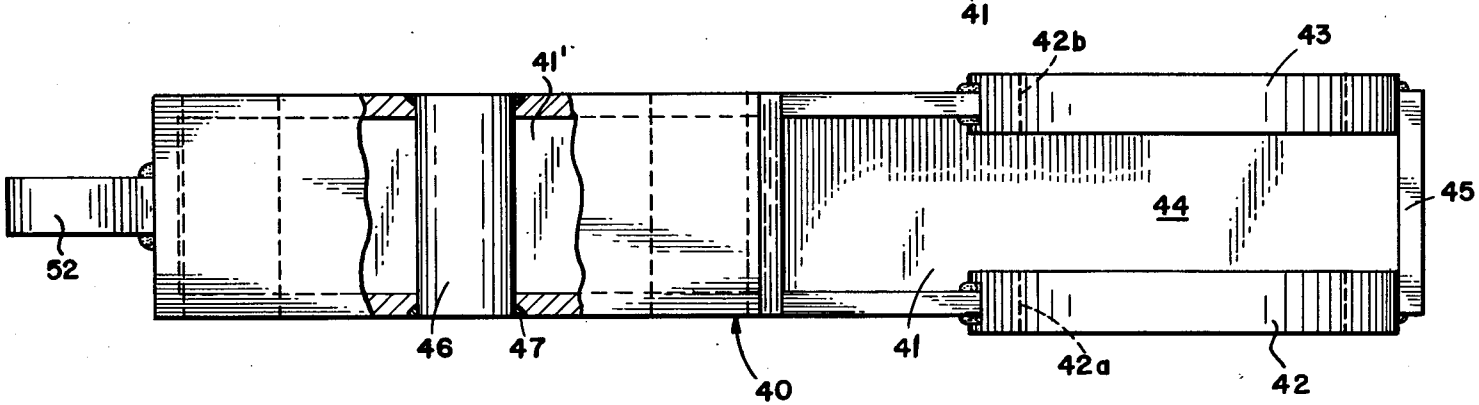
FIG. 4.

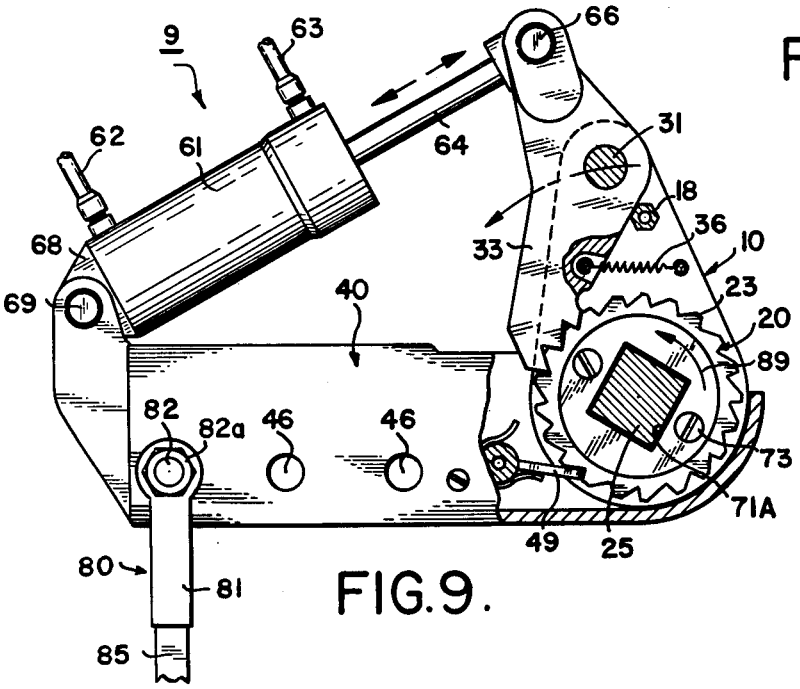
FIG. 9.
FIG. 8.
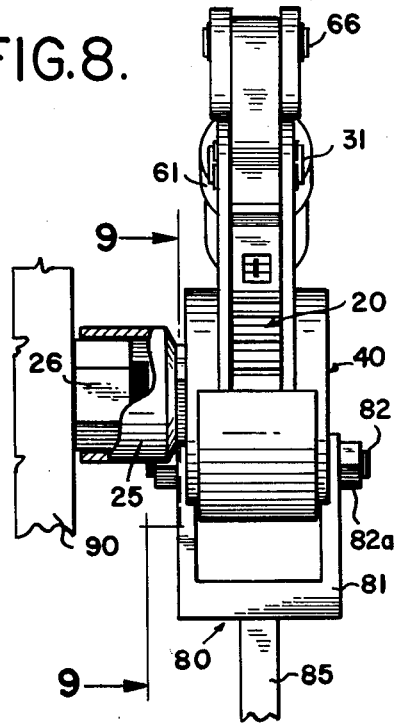
FIG. 11.
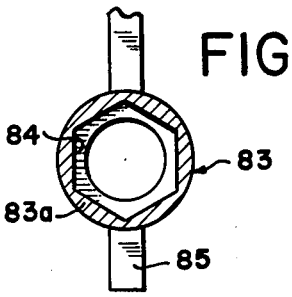
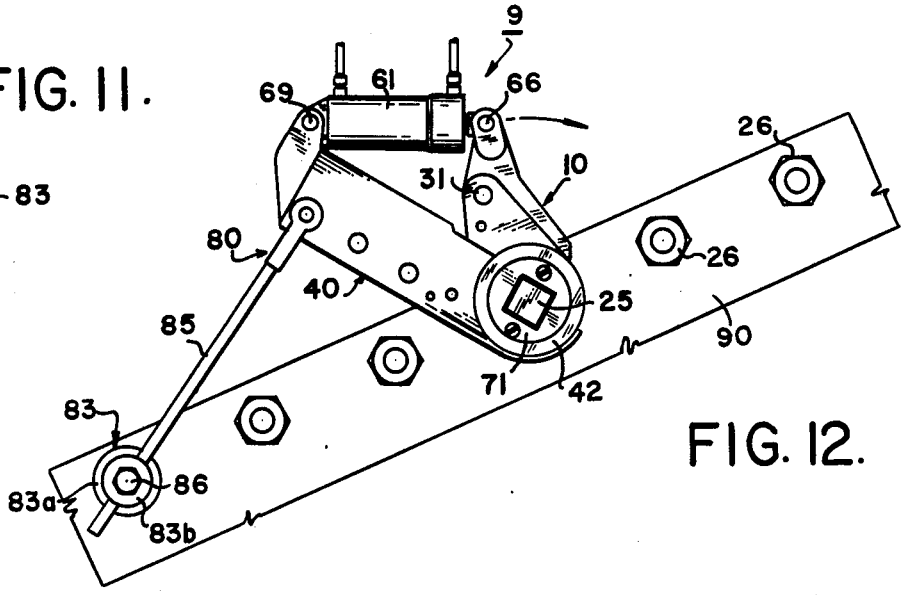
FIG. 12.
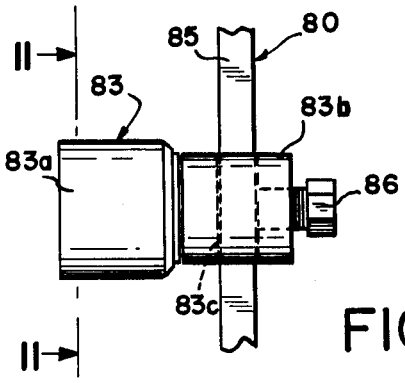
FIG. 10.

HIGH POWER WRENCHING TOOL

BACKGROUND OF THE INVENTION

A high power wrenching tool, such as is described in U.S. Pat. No. 3,706,244 ("the 244 patent"), is now widely used on flanged connections. The 244 patent is assigned to the same assignee. Each full rotation of the wrench is usually limited to an angular excursion ranging between 30° and 70°. A drawback of such power wrenches is that, after each full rotation, the wrench must be lifted from the threaded connector on the flanged connection and repositioned for the next cycle of rotation.

A high-torque ratchet wrench for loosening or tightening nuts and bolts, which lends itself for applications such as are described in the 244 patent, but which overcomes the above mentioned drawback is described in U.S. Pat. No. 4,091,890 ("the 890 patent"), assigned to the same assignee.

The present invention is a power wrenching tool which utilizes the high-torque wrench described in the 890 patent. The wrench itself comprises two parallel side plates. Each plate has at one end thereof a bore. A ratchet wheel and a cooperating drive pawl are operatively mounted between the plates. The ratchet wheel defines at its center a socket and carries a plurality of angularly-spaced teeth on its circumferential periphery. A cylindrical boss outwardly extends from each side of the wheel. The bosses are rotatably mounted in the bores of the plates. The pawl has a base which is pivotable on or about a pivot which transversely extends between the plates. A pawl foot extends laterally and downwardly of the pivot. The pawl foot has teeth adapted to mesh with the ratchet wheel teeth. A pawl arm extends upwardly of the pivot. The pawl foot is adapted to receive from the pawl arm a radial force which urges the pawl foot teeth to engage with the ratchet wheel teeth, and a tangential force which rotates the ratchet wheel.

SUMMARY OF THE INVENTION

The high-power wrenching tool utilizes the high-torque ratchet wrench, described in the 890 patent, which is mounted on a frame that supports and provides the necessary reaction forces to the ratchet wrench. The frame has a main beam from one end of which extends a pair of transversely-spaced outer rings having co-axial bores. The wrench is adapted to snugly slide into the space between the rings in either of two positions that are 180° from each other. A pair of cylindrical hubs are removably securable to the opposite bosses on the wheel. The hubs are rotatably mounted within the bores in the rings. Each hub has a slot identical to a center slot in the ratchet wheel. The hubs' slots are co-axial and aligned to receive therethrough a mating drive socket within the slot of the wheel. A reciprocating actuator is coupled between the pawl arm and the other end of the frame.

BRIEF DESCRIPTION OF THE DRAWINGS

FIG. 2 is a view in elevation of the frame alone;

FIG. 3 is an end view of the frame shown in FIG. 2;

FIG. 4 is a top view of the frame shown in FIG. 2;

FIG. 8 is an end view of the fully assembled tool with its socket shown partly in section over a threaded connector;

FIG. 9 is a front view of the tool, partly in section, on line 9—9 in FIG. 8, which illustrates the ratchet wrench in a position on the frame for torquing in a counterclockwise direction;

FIG. 10 is a partial view of the outer end of the support bracket for the frame, whose inner end is shown in FIGS. 8 and 9, and a front view of an anchor socket mounted on the support bracket;

FIG. 11 is a view on line 11—11 in FIG. 10; and

FIG. 12 is a front view which shows the tool mounted with the support bracket on a flanged connection with the wrench in its position for exerting a torque in a clockwise direction.

DETAILED DESCRIPTION OF A PREFERRED EMBODIMENT

Figure 1:
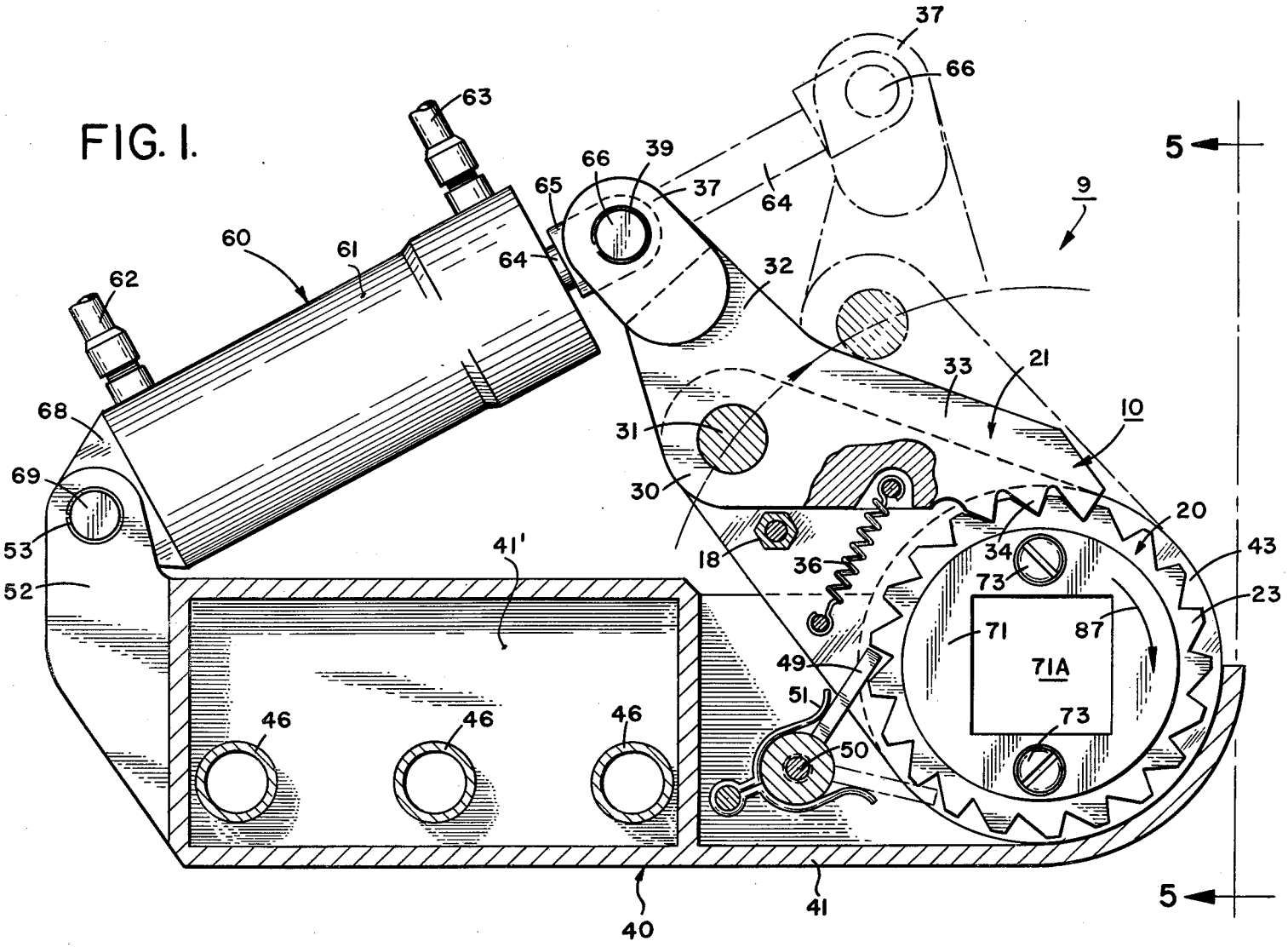
FIG. 1 is a view in elevation, partly in section, of the high power wrenching tool of this invention.

The power wrenching tool, generally designated as 9, will be described first in connection with its parts. Then will follow the description of its assembly and of its use.

A. The High Torque Ratchet Wrench

Referring to the drawings and especially to FIGS. 1, 6–7, and 9, the ratchet wrench, generally designated as 10, is preferably of the type which is described in said U.S. Pat. No. 4,091,890. The detailed description of wrench 10 in the 890 patent is incorporated herein by reference. Only a brief description thereof will be given herein.

Wrench 10 comprises a housing 13 (FIG. 7) having two spaced-apart side plates 14 and 15 defining registering cylindrical bores 16, 17, respectively. The plates are held in spaced-apart relationship by a bolt and nuts 18 (FIG. 1). A ratchet wheel 20 (FIG. 6) and a cooperating drive pawl 21 (FIG. 1) are operatively mounted in the space 13' defined between plates 14 and 15.

Ratchet wheel 20 has a pair of laterally-extending side bosses 22 (FIG. 6) which allow the wheel to become rotatably mounted within the bores 16 and 17. Ratchet wheel 20 has on its outer peripheral wall a plurality of identical teeth 23 and defines at the center thereof a geometric slot 24 into which an appropriate drive socket 25 (FIGS. 8, 9) is removably insertable for torquing a threaded member 26 such as a bolt or a nut.

Figure 5:
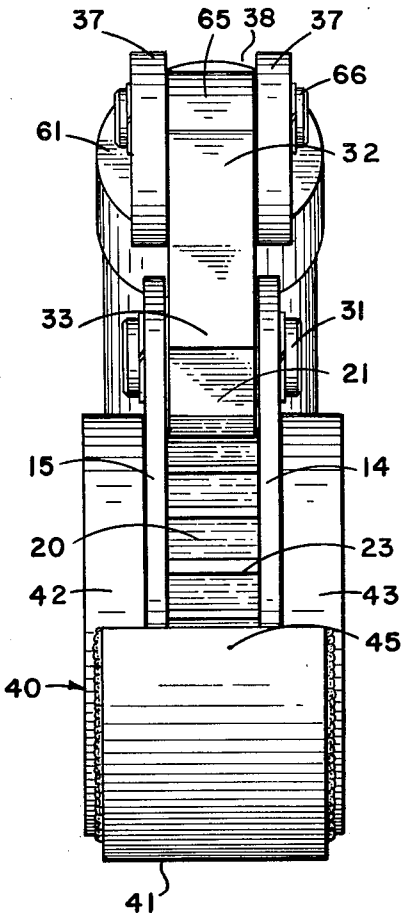
FIG. 5 is an end view of the tool on line 5—5 in FIG. 1.

Pawl 21 (FIG. 1) has a base portion 30 which is pivotable between plates 14 and 15 on or about a pivot 31; a pawl arm 32 laterally and upwardly extends from base 30; and a pawl foot 33 laterally and downwardly extends from base 30. Pawl foot 33 has at least two teeth 34 which are adapted to match and mesh with the teeth 23 of the ratchet wheel 20. A coil spring 36 assists in urging pawl foot 33 against the ratchet wheel 20. Outwardly extending from the pawl arm 32 are two spaced-apart side walls 37 (FIG. 5) forming a channel 38 therebetween. Side walls 37 have registering holes 39 (FIG. 1).

B. The Frame

Figure 6:
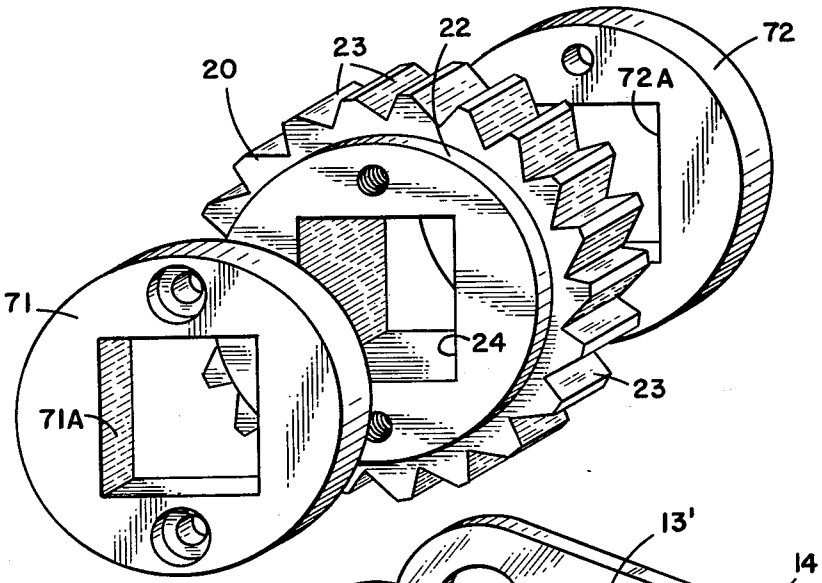
FIG. 6 is an exploded view of the ratchet wheel and of the hubs attachable thereto.
Figure 7:
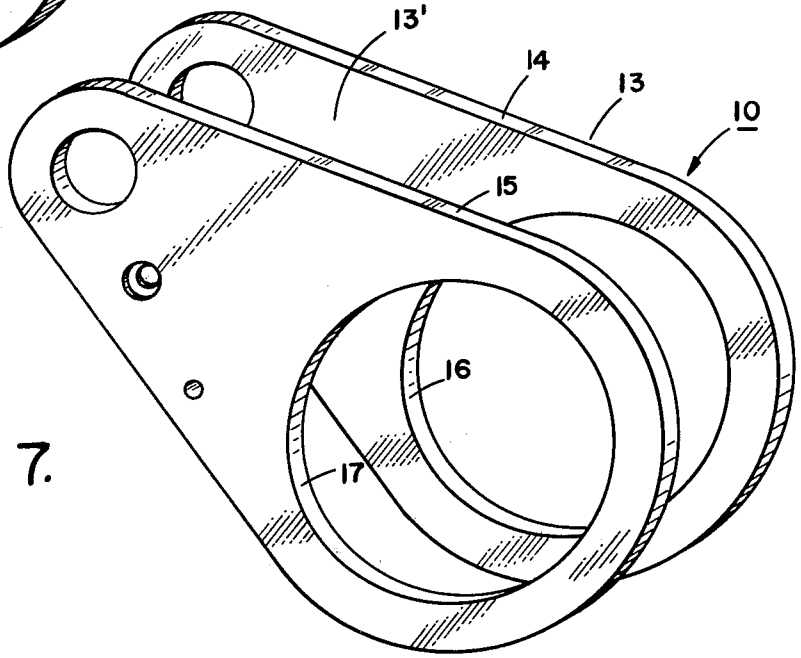
FIG. 7 is an exploded view of the side plates which form the housing for the high-torque wrench that supports the ratchet wheel and the pawl.

The frame, generally designated as 40 (FIGS. 1–4), supports and provides a reaction to the ratchet wrench 10. The frame includes a beam 41 from the front end of which outwardly extends a pair of transversely-spaced parallel rings 42, 43 forming a channel 44 (FIG. 4) therebetween. The rings 42, 43 are maintained rigid relative to each other by a curved, bottom cross plate 45. Rings 42, 43 define bores 42*a*, 42*b* respectively. The inner diameter of these bores is slightly larger than the diameter of bosses 22 on the ratchet wheel 20 (FIG. 6).

A portion 41' (FIG. 1) of the body of beam 41 can be hollowed out to make it lighter. Extending through the hollow portion 41' of beam 41 are one or more sleeves 46 which can be welded to the beam, as shown at 47 (FIG. 4). The axes of sleeves 46 are perpendicular to the longitudinal axis of beam 41.

A retaining pawl 49 (FIG. 1, 9) is rotatably mounted on a pivot 50. A spring 51 limits the angular rotation of pawl 49 between two angular positions and urges the engagement thereof with ratchet wheel 20. The rear end of beam 41 is provided with an upwardly extending post 52 having a bore 53 therein.

C. The Fluid-Operated Actuator

The fluid-operated actuator 60 (FIG. 1) has a cylinder 61 containing a double-acting piston (not shown) which is pressured by two opposite inlet-outlet fluid lines 62, 63. Extending from the piston is a ram 64 having an outer head 65 which fits inside the channel 38 formed between the side plates 37. Head 65 is coupled to side plates 37 by a pivot 66 which extends through bores 39 in the side plates 37. The base 68 of cylinder 61 is pivotably mounted on or about a pivot 69 extending through the bore 53 in the upright post 52.

D. Assembly of the Power Tool

The fully-assembled wrench 10 is adapted to snugly slide into the channel 44 (FIG. 4) formed between the transversely-spaced plates 42, 43, whereby the side bosses 22 of ratchet wheel 20 will be positioned directly opposite to bores 42*a* and 42*b*. The wrench 10 can assume two positions: one as shown in FIGS. 1, 12 and the other as shown in FIG. 9. These two positions are 180° from each other.

A pair of cylindrical hub plates 71, 72 (FIG. 6) are provided, each having an outer diameter slightly less than the inner diameter of bores 42*a* and 42*b* (FIG. 4) which form bearing surfaces for the hub plates. Hub plates 71, 72 have geometric center slots 71A, 72A, respectively, which are identical in shape to slot 24 of ratchet wheel 20. Slots 71A, 72A and slot 24 preferably have a square cross section. The hub plates 71, 72 are detachably secured to the opposite bosses 22 by diametrically-opposed screws 73 (FIG. 1) so that the square slots 24, 71A and 72A are in register with each other and form a single continuous square slot.

E. The Use and Operation of the Tool

To change the position of the ratchet wrench 10 relative to the frame 40 all that is necessary is to remove pin 66 (FIG. 1) and to detach the hub plates 71 and 72 from their opposite bosses 22 by removing screws 73.

In use, while tool 9 tightens a nut 26 (FIGS. 8–12) frame 40 can be reacted against an adjacent nut 26 on a flanged connection 90 with the aid of a bracket 80 having a fork portion 81 to which the beam 41 of frame 40 can be secured by nuts 82*a* and by a bolt 82 extending through one of the sleeves 46. The outer end of bracket 80 can be a post 85 on which is slidably mounted a reaction socket 83 having a socket 83*a* and a swivel 83*b* defining therethrough a bore 83*c*. Socket 83*a* forms a hex bore 84 (FIG. 11) to accommodate a nut 26 therein. Swivel 83*b* is secured to beam 85, which extends through bore 83*c*, by a threaded bolt 86.

In operation, the tool 9 can torque in either a clockwise or counter-clockwise direction depending on the position of wrench 10 within the frame 40. In the position of wrench 10, as shown in FIGS. 1, 12, an extension of the ram 64 will cause the ratchet wrench 10 and its wheel 20 to turn in a clockwise direction (FIG. 1) as shown by the arrow 87. A retraction of the ram 64 will cause pawl 21 to rotate in a counter-clockwise direction about stationary wheel 20 (lost motion). Retaining pawl 49 is in its position as shown in FIG. 1 so as to prevent the ratchet wheel 20 from also rotating in a counter-clockwise direction. The fully extended position of the ram 64 and the corresponding position of the ratchet wrench 10 are shown in FIG. 1 by the dotted lines.

In the other or opposite position of the ratchet wrench 10 relative to frame 40, as shown in FIG. 9, a retraction of ram 64 will torque the ratchet wheel 20 in a counter-clockwise direction 89 while an extension of ram 64 will produce the lost motion of pawl 21 in a clockwise direction. It will be noted that in FIG. 9, the retaining pawl 49 is in its alternate position to prevent the ratchet wheel 20 from also turning in a clockwise direction.

Thus, for each full stroke of ram 64, ratchet wheel 20 will rotate a predetermined angular distance either in the clockwise or counter-clockwise direction, thereby tightening or loosening the threaded member 26 (FIG. 12). Without bracket 80 and its reaction socket 83, frame 40 can be reacted against adjacent threaded members 26, while with the use of the support bracket 80 frame 40 can be reacted against remotely positioned such threaded members.

The advantages and the inherent flexibility of operation of the above-described power tool 9 will be apparent to those skilled in the art. Thus, it will be appreciated that the tool 9 of the present invention is relatively compact, light weight, and easy to use in the field on different bolt or nut patterns. The ratchet wrench 10 can be separated from frame 40 and from hydraulic actuator 60 and very quickly repositioned on frame 40, thereby changing the mode of operation of tool 9. Other advantages will also readily become apparent.

What is claimed is:

1. A high-power wrench tool comprising in combination, (a) a high-torque ratchet wrench having two parallel side plates, each plate having at one end thereof a bore; a ratchet wheel and a cooperating pawl being operatively disposed between said plates; said wheel having a slot for receiving therein a mating drive socket; a plurality of angularly spaced teeth on the outer peripheral wall of said wheel; a cylindrical boss laterally extending from each side of said wheel, said bosses being rotatably supported in said bores of said plates; said pawl having a base, a pin traversely extending between said plates for pivotably mounting said pawl on said plates; a pawl arm extending laterally and upwardly relative to said base, a pawl foot extending laterally and downwardly relative to said base, and said pawl foot having teeth adapted to mesh with the ratchet wheel teeth;

(b) a frame supporting said ratchet wrench and in use providing a reaction force thereto; said frame having a beam, a pair of transversely spaced outer rings extending from one end of said beam and forming a channel therebetween, and said ratchet wrench being adapted to slide into said channel in either of two positions that are 180° from each other;

(c) a pair of hubs removably secured to the opposite bosses of said ratchet wheel; each hub having a slot which is in register with the slot of the ratchet wheel for accepting said drive socket therethrough; said hubs being rotatably mounted on said outer rings which extend from said beam; and (d) a fluid-operated actuator having a double-acting piston, a ram extending from said piston, said ram being detachably coupled to said pawl arm, and said cylinder being pivotably coupled to the other end of said beam.

2. The tool of claim 1 wherein said slots have a rectangular cross section.

3. The tool of claim 1 wherein said beam is hollow and at least one sleeve extends transversely of said beam.

4. The tool of claim 3 and a support bracket pivotably coupled to said beam on a bolt extending through said sleeve, and a post extending outwardly from said bracket.

5. The tool of claim 4 and an anchor socket slidably mounted on said post.

6. The tool of claim 5 wherein said anchor socket includes a socket mounted on a swivel defining a bore therethrough for slidably accepting said post of said support bracket.

7. A high-power wrench tool comprising in combination, (a) a high-torque ratchet wrench having a housing, a ratchet wheel and a cooperating pawl being operatively disposed within said housing; said wheel having a slot for receiving therein a mating drive socket; a plurality of angularly spaced teeth on the outer peripheral wall of said wheel; said wheel being rotatably supported in said housing; and said pawl having teeth adapted to mesh with the ratchet wheel teeth;

(b) a frame supporting said ratchet wrench and in use providing a reaction force thereto; said frame having a beam forming a channel, and said ratchet wrench being adapted to slide into and out of said channel;

(c) a pair of hubs removably secured to said ratchet wheel; each hub having a slot which is in register with the slot of the ratchet wheel; said hubs being rotatably mounted on said beam; and (d) a fluid-operated actuator having a double-acting piston, a ram extending from said piston, said ram being detachably coupled to said pawl, and said cylinder being coupled to the other end of said beam.

* * * * *